United States Patent [19]

Parrish

[11] 4,055,399

[45] Oct. 25, 1977

[54] TRACERS IN PREDETERMINED CONCENTRATION RATIOS

[75] Inventor: David R. Parrish, Tulsa, Okla.

[73] Assignee: Standard Oil Company (Indiana), Chicago, Ill.

[21] Appl. No.: 744,478

[22] Filed: Nov. 24, 1976

[51] Int. Cl.[2] ..... E21B 47/00; G01N 33/24

[52] U.S. Cl. ..... 23/230 EP; 250/259; 166/252; 73/155

[58] Field of Search ..... 23/230 EP; 250/259, 250/302; 166/252; 73/155

[56] References Cited

U.S. PATENT DOCUMENTS

| | | | |
|---|---|---|---|
| 2,318,689 | 5/1943 | Hodell et al. | 250/259 |
| 3,258,072 | 6/1966 | Froning | 166/252 |
| 3,372,746 | 3/1968 | Sanderson et al. | 23/230 EP |
| 3,508,875 | 4/1970 | Sandford | 23/230 EP |
| 3,508,876 | 4/1970 | Polly | 23/230 EP |
| 3,590,923 | 7/1971 | Cooke | 166/252 |
| 3,811,501 | 5/1974 | Burnett et al. | 166/252 |
| 3,851,171 | 11/1974 | Saniford | 250/259 |
| 3,902,362 | 9/1975 | Tomich et al. | 73/155 |

*Primary Examiner*—Robert M. Reese
*Attorney, Agent, or Firm*—Albert C. Metrailer; Arthur McIlroy

[57] ABSTRACT

A method for tracing the flow of a plurality of fluid slugs injected into a subsurface formation using a number of tracers smaller than the number of fluid slugs. Single tracers are used in a number of fluid slugs equal to the number of tracers. In the remaining injected fluid slugs, combinations of at least two of the tracers in predetermined concentration ratios are used. Recovered fluid is analyzed for the presence of each of the tracers and the ratios of the tracers indicates breakthrough of each injected slug.

3 Claims, No Drawings

TRACERS IN PREDETERMINED CONCENTRATION RATIOS

BACKGROUND OF THE INVENTION

This invention relates to a method for studying the flow of fluids in subterranean formations and more particularly to tracing the flow of a plurality of injected fluid slugs by use of a number of tracers smaller than the number of injected fluid slugs.

Petroleum is often removed from subterranean formations by injecting water in one or more wells and producing oil and water at one or more other wells. To most efficiently operate such a waterflood production process it is desirable to know the flow pattern of water through the subterranean formations from the injection wells to the production wells. The use of particular materials to trace such water flow is well documented by the disclosures of previous patents.

U.S. Pat. No. 3,508,875, issued to B. B. Sandiford on Apr. 28, 1970, discloses the use of water-soluble iodide, thiocyanate, and salicylate compounds in up to three injection wells at one time. While the use of these three materials was previously known, this patent added the improvement of a simple test procedure which would detect the presence of any one or all of the compounds.

U.S. Pat. No. 3,508,876, issued to O. L. Polly on Apr. 28, 1970, discloses the use of various water-soluble aldehydes as water flow tracers. U.S. Pat. No. 3,851,171, issued to B. B. Saniford, et al., on Nov. 26, 1974, discloses yet another and more complicated chemical compound, water-soluble substituted poly(hydroxyalkyl) bis(triazinylamino) stilbene, which is useful as a water tracer.

As is recognized in the above-referenced patents, the number of practical water tracing compounds is limited by several requirements. Tracers must, of course, be highly soluble in water or other fluid being traced. Useful tracers should be essentially insoluble in formation oil which is typically present. The tracer should not adsorb onto rock surfaces in the formation as the fluid passes through the formation. If the tracer is either soluble in oil or tends to adsorb on the rock, it may be totally lost in the formation or its effective movement through the formation may be slower than the fluid that is being traced.

The fact that certain tracers are delayed by formation oil or rocks is illustrated by U.S. Pat. No. 3,590,923, issued to C. E. Cooke, Jr., on July 6, 1971. In this patent two different tracers are mixed and injected with water to pass through a portion of the formation to a production well. One of the two tracers is delayed in transit due to its having a higher solubility the in immobile oil in the formation than the other. In this disclosure the difference in delay time is used as a measure of the oil saturation of the formation. In a similar way, U.S. Pat. No. 3,902,362, issued to Tomich, et al., on Sept. 2, 1975, discloses the use of two tracers having different partition coefficients in a single well to measure the natural fluid drift of the mobile phase present in the formation.

Thus, while it is seen that the use of tracers of trace water flow in subterranean formations is well-known, the number of useful and preferred tracers is small. Therefore, when the number of injection wells in a producing formation is larger than the number of available and suitable tracers, there is no way of accurately and simultaneously tracing the flow of water from each of the injection wells to a production well.

Secondary and tertiary oil recovery methods make the need for more tracers even more apparent. For example, in a micellar fluid injection process there may be four distinct banks or slugs of fluid injected in each injection well. To accurately monitor the progress of a micellar flood, each of these four banks should have its own tracer and, of course, the tracers for each of a number of wells must be different.

While the above discussion covers specifically the area of oil recovery by use of water or water-based fluid injection, similar flooding processes are known in which gases are injected to displace oil. These gases include petroleum gases such as methane and propane and also carbon dioxide. As with water injection, gases are typically injected into a number of wells and oil produced at other wells. Gaseous tracers are known and are used to trace the flow of injected gas from each injection well to the production well just as in waterflooding. The number of such available gaseous tracers is limited and additional tracers are desirable.

SUMMARY OF THE INVENTION

Accordingly, an object of the present invention is to provide a method for tracing the flow of a plurality of fluid slugs injected into a subsurface formation by use of a number of tracers smaller than the number of fluid slugs.

According to the present invention, flow of a plurality of injected fluid slugs is traced by means of a smaller plurality of tracers by adding a different one of each of said tracers to each of a number of fluid slugs equal to the number of tracers and adding at least two of said tracers in different preselected ratios to each of the remaining fluid slugs. Analysis of recovered fluid for the content of each of the tracers indicates from which injected fluid slugs produced fluids originated.

DESCRIPTION OF THE PREFERRED EMBODIMENTS

The present invention will be illustrated by means of simple examples involving the use of only two tracers, hereinafter referred to as Tracer A and Tracer B, to trace the flow of injected water from four injection wells to one production well. The injection wells will hereinafter be referred to simply as Well No. 1 through Well No. 4 without consideration of the relative position of the four injection wells and the production or recovery well. Two of the wells will have only a single tracer added to injected water, since two distinct tracers are available. For example, Well No. 1 will have only Tracer B added, and Well No. 4 will have only Tracer A added. The concentrations and total quantities added to Wells 1 and 4 are the same as taught by the prior art. For economical operation, the lowest quantity of tracer which will yield a detectable concentration at the production well is typically used. For this example, a concentration of 100 ppm for each tracer in wells 1 and 4 is assumed.

Since only two tracers are available and two wells remain to have tracers added to them, both of the two tracers wll be added to both of the remaining wells. Well 2 will have Tracers A and B added in a 1:2 ratio. Well 3 will have Tracers A and B added in a 2:1 ratio. It is apparent that the total concentration of the low-level tracer in each of the injection Wells 2 and 3 must be designed to allow reliable detection of that tracer at the production well. With the 2:1 ratio used in this example, the high-level tracer will therefore have twice this minimum detectable concentration. For example, if it is determined that for injection Well No. 2 that Tracer A must be added in concentration of 100 ppm, then Tracer B must be added at 200 ppm. For this example a low-level tracer concentration of 100 ppm will be assumed for both Well No. 2 and Well No. 3.

As is typically done in the prior art, all of the various tracers and combinations thereof are added to Well Nos. 1 through 4 simultaneously at known injection rates and the injection is continued for a time sufficient to insure detection at the sample rate selected. The breakthrough of water from the injection wells to the production well is detected by taking samples of the produced water on a regular basis (for example, daily) and quantitatively analyzing the sample for the concentration of each of Tracers A and B present in the sample. If the first traced water slug to break through at a production well is from Well No. 1, and it is 30% of the water reaching the production well, a log of the tracer concentrations will show a 30 ppm concentration increase of Tracer B. If, for example, a later sample includes water from injection Well No. 2, which provides 25% of the produced water, then Tracer A should be detected in a concentration of 25 ppm and Tracer B should be detected in a concentration of 80 ppm, assuming that the tracer from Well No. 1 is still being received. The breakthrough from Well No. 2 would therefore be identified by the change in tracer concentrations being in the ratio of 1:2 of Tracer A relative to Tracer B. In a similar manner, if a later sample contains water from Well No. 3, making up 25% of the produced water and tracers from Well Nos. 1 and 2 are still being received, then a total of 75 ppm for Tracer A and 105 ppm of Tracer B should be measured. Since these concentrations represent an increase of 2:1 of Tracer A relative to Tracer B, the increase can be identified as a breakthrough of water from Well No. 3. Finally, if water from Well No. 4 breaks through and makes up 20% of the total produced water while the tracers from Well Nos. 1, 2, and 3 are still present, the total concentration of Tracer A of 95 ppm and Tracer B of 105 ppm should be measured. This 20 ppm increase of Tracer A is then identified as the breakthrough of water from Well No. 4.

A different pattern of concentrations in the samples will result if the end of one traced water slug occurs before a later one starts. In practice, this is likely to occur when the tracers are added to the injected water in a spike, that is, a single addition of essentially pure tracer. This is often done in practice, because it is much simpler than installing special metering apparatus to mix the tracer with injected water. The spike is generally spread out by the action of the formation so that it appears at the production well over a period of a day or more and thus is detectable by daily sampling. If such an injection method is used, the above example would yield simpler results since there is less overlap of the produced tracers. The first sample to contain traced water from Well No. 1 may show 30 ppm Tracer B as before. A later sample containing water from Well No. 2 may contain 25 ppm Tracer A and 75 ppm (50 ppm from Well No. 2 and 25 ppm from Well No. 1) Tracer B. As the tracer from Well No. 1 dissipates, the readings would then decrease to 25 ppm Tracer A and 50 ppm Tracer B. These results would show that the slug from Well No. 1 was ending as the slug from Well No. 2 arrived. As the slug from Well No. 2 begins to dissipate and the slug from Well No. 3 arrives at the production well, a sample containing 70 ppm (20 ppm from Well No. 2 and 50 ppm from Well No. 3) Tracer A and 65 ppm (40 ppm from Well No. 2 and 25 ppm from Well No. 3) Tracer B could be expected. When the slug from Well No. 2 is completely dissipated, the samples should show an almost exact 2:1 ratio of Tracer A to Tracer B. Finally, as the water from Well No. 4 arrives at the production well and the slug from Well No. 3 dissipates, a sample containing, for example, 60 ppm (40 ppm from Well No. 3 and 20 ppm from Well No. 4) Tracer A and 20 ppm (all from Well No. 3) Tracer B would be expected. Again, the Well No. 3 slug would dissipate so that a final sample would contain only Tracer A.

While there is a slight chance of ambiguity in the results of a log of tracer concentrations according to the present invention, this chance is so small that it can usually be ignored. In the above examples, it is possible for the water from injection Well Nos. 2 and 3 to breakthrough at the production well simultaneously and in exactly equal amounts. If this occurred, then the increases in concentrations of Tracers A and B would be equal. Such an increase would be no different than the increase caused by simultaneous breakthrough of water from Wells 1 and 4 also in equal amounts. Such an equal increase of both tracers would be resolvable in essentially all cases by observing earlier or later changes in tracer concentration. For example, if an earlier sample had shown a stepped increase of only Tracer B, then the later simultaneous increase of both A and B in equal amounts could only be caused by the simultaneous breakthrough from Wells 2 and 3 in equal amounts. Since in practice the occurrence of both conditions, i.e., both simultaneous breakthrough and in exactly the proper proportions, is extremely unlikely, the problem should never arise, but if it does it can be solved.

As stated above, the process of the present invention generally requires quantitative measurement of the tracer content of produced waters. The testing methods required to make such quantitative analysis of the known useful tracer are well-known in the art and such tests are available on a commercial basis. Although such quantitative measurement is preferred in the process of the present invention, it is not absolutely required. For example, in many cases of tracing water flow, alcohols such as methanol and isopropynol may be used as these tracers. The content of such tracers can be analyzed accurately using well-known gas chromatograph equipment. While the outputs of such gas chromatographs are usually calibrated to provide absolute quantitative output readings, they can provide the basic ratio information needed in the present inventions without such calibration. A sample containing, for example, both methanol and isopropynol can be analyzed on a gas chromatograph to provide the concentration ratio of the two tracers in a single test without calibration for absolute concentrations. The measurement of absolute concentration is preferred though, since it provides additional information relating to the total quantities of water from each injection well which is reaching the production well.

The present invention is not limited to the injection of a single combination of tracers in a single injection well. For example, in some oil recovery projects, a number of different banks of materials are injected into each injection well in sequence. For example, a preflush slug may be followed by a slug of micellar fluid, which may then be followed by a slug of polymer containing water, which in turn may be followed by an available flood water. In such a case, it may be desired to place different tracers in each of the different banks of fluids so that the arrival of each bank at a production well may be detected. While in practice there usually would be available four distinctly different tracers for the injection and production well pattern described in the example above, there would not be a sufficient number of tracers if four different tracers were needed for each of the four injection wells. By extension of the above example of four tracers and all 1:2 and 2:1 ratio combinations of pairs of four tracers, it can be seen that 16 distinct tracers can be provided for such a process. It is also apparent that a large number of distinct tracers could be generated by providing combinations of more than 2 and by providing ratios other than the 1:2 and the 2:1 ratios.

Although the present invention has been shown and illustrated in terms of a specific process, it will be apparent that changes or modifications can be made without departing from the spirit of the invention as defined by the appended claims.

We claim:

1. A method for tracing the flow of three or more slugs of fluid injected into a subsurface formation by means of a smaller number of tracers comprising:

adding a different one of said tracers to each of a number of injected fluid slugs equal to the number of said tracers;

adding a different preselected ratio of at least two of said tracers to each of the remaining injected fluid slugs;

recovering a sample of fluid at a recovery point; and analyzing said sample to determine the concentration of each of said tracers.

2. A method for tracing the flow of water from three or more origin points by use of a smaller number of tracers comprising:

adding a different one of said tracers to each of a number of origin points equal to the number of tracers;

adding a different preselected ratio of at least two of said tracers to each of the remaining origin points;

recovering a sample of water at a recovery point; and analyzing said sample to determine the concentration of each of said tracers.

3. A method for tracing the flow of water from three origin points which comprises:

adding a first tracer to a first of three origin points;

adding a second tracer to a second of said three origin points;

adding both said first tracer and said second tracer in a preselected ratio to a third of said three origin points;

recovering a sample of water at a recovery point; and analyzing said sample to determine the concentrations of said first and second tracers.

* * * * *